United States Patent [19]

White, Jr.

[11] Patent Number: 4,981,422

[45] Date of Patent: Jan. 1, 1991

[54] GEROTOR DEVICE HAVING A VALVE OPENING DIAMETER SMALLER THAN THE DRIVE CONNECTION DIAMETER

[75] Inventor: Hollis N. White, Jr., Hopkinsville, Ky.

[73] Assignee: White Hydraulics, Inc., Hopkinsville, Ky.

[21] Appl. No.: 229,535

[22] Filed: Aug. 8, 1988

Related U.S. Application Data

[63] Continuation-in-part of Ser. No. 77,869, Jul. 27, 1987, abandoned.

[51] Int. Cl.[5] ..... F01C 1/08; F03C 2/08

[52] U.S. Cl. ..... 418/60; 418/61.3; 418/186

[58] Field of Search ..... 418/60, 61.3, 186

[56] References Cited

U.S. PATENT DOCUMENTS

| | | | |
|---|---|---|---|
| 3,316,814 | 5/1967 | Charlson | 418/61.3 |
| 3,863,449 | 2/1975 | White, Jr. | 418/61.3 |
| 3,876,343 | 4/1975 | Giversen | 418/61.3 |
| 4,715,798 | 12/1987 | Bernstrom | 418/61.3 |
| 4,741,681 | 5/1988 | Bernstrom | 418/186 |

*Primary Examiner*—John J. Vrablik

*Attorney, Agent, or Firm*—Woodling, Krost & Rust

[57] ABSTRACT

A gerotor device with an orbiting valve wherein the outside diameter of the valving passages in the orbiting valve are smaller than the inside diameter of the rotor wobblestick drive connection.

18 Claims, 4 Drawing Sheets

GEROTOR DEVICE HAVING A VALVE OPENING DIAMETER SMALLER THAN THE DRIVE CONNECTION DIAMETER

This application is a continuation-in-part of Ser. No. 077,869 filed July 27, 1987, now abandoned.

FIELD OF THE INVENTION

This invention relates to an improved gerotor device.

BACKGROUND OF THE INVENTION

Gerotor hydraulic devices are becoming more and more common place. In addition to the archtypical agricultural operations such devices are now also found in industrial applications such as robots and mechanized transportation equipment. With these increasing numbers of applications certain, previously ignored, inherent operating characteristics are beginning to intrude The present invention is directed towards providing a more practical, cost-effective higher and smoother torque gerotor device.

SUMMARY OF THE INVENTION

The present invention is directed towards providing a gerotor device having a smooth, even torque.

It is an object of this invention to facilitate the valving of the device throughout its entire 360 degree rotation.

It is an object of this invention to increase the torque of gerotor devices.

It is an object of this invention to increase the longevity of gerotor devices.

Other objects and a more complete understanding of the invention may be had by referring to the following specification and drawings in which:

DESCRIPTION OF THE PREFERRED EMBODIMENT

Figure 1:
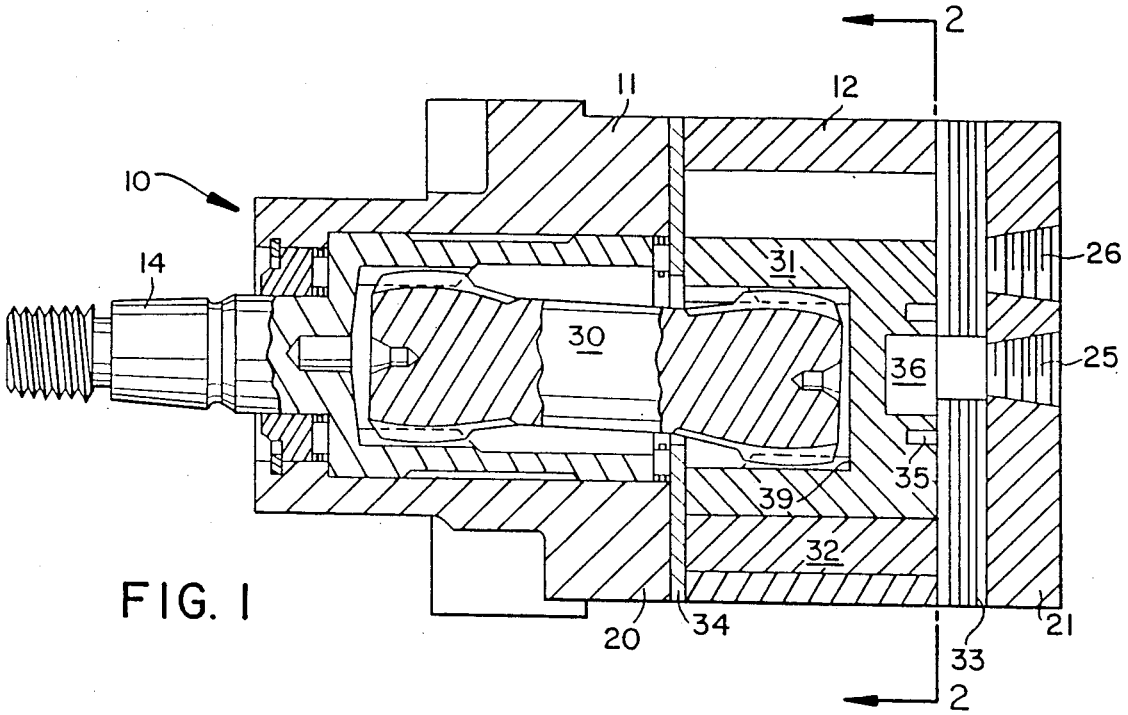
FIG. 1 is a central longitudinal cross-sectional view of an integral valve gerotor device incorporating the improved valve of this present application.
Figure 2:
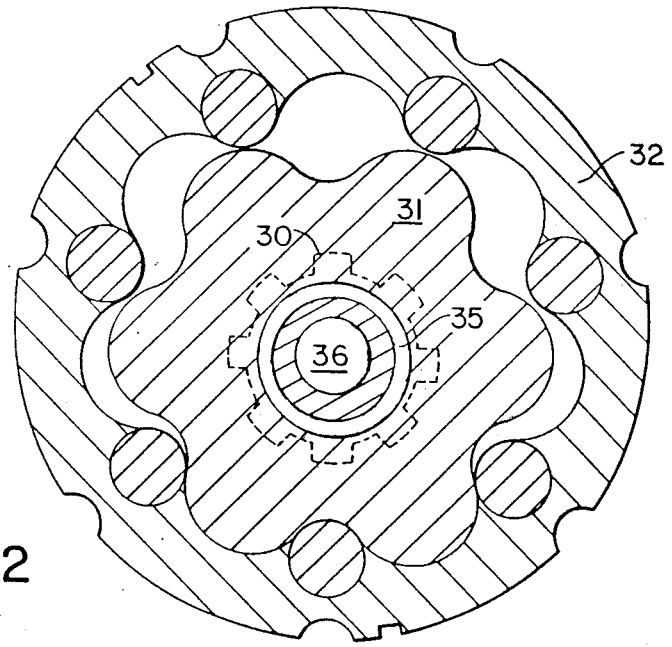
FIG. 2 is a lateral cross-sectional view of the improved device of FIG. 1 taken generally along lines 2—2 of that FIGURE.

The invention of this present application relates to an improved gerotor device 10. The preferred device includes a housing 11, a gerotor structure 12 and a drive shaft 14.

The housing 11 is a steel structure some 8" in length. The housing 11 includes a front mounting and bearing member 20, a gerotor structure 12 and a porting member 21 end plate. The front member 20 is designed to mount the device 10 onto any associated mechanism and to retain the drive shaft 14 in place against loads including radial side loads. The gerotor structure 12 is designed to provide the operative power for the device. The porting member 21 is designed to provide a single, heavy unitary plate for the fixed connection of tubing to the input and discharge ports 25, 26 for the device 10.

The gerotor structure 12 includes a wobblestick 30; a rotor 31; a stator 32; a manifold plate 33; and a balancing plate 34.

The wobblestick 30 is the main angular drive connection between the rotor 31 and the drive shaft 14. This wobblestick 30 is therefore long (to reduce the angle between the longitudinal axis of the wobblestick 30 and the longitudinal axis of the drive shaft 14) and of a sizeable diameter (to handle the torque of the rotor 31). The wobblestick 30 is sized for the application.

Figure 4:
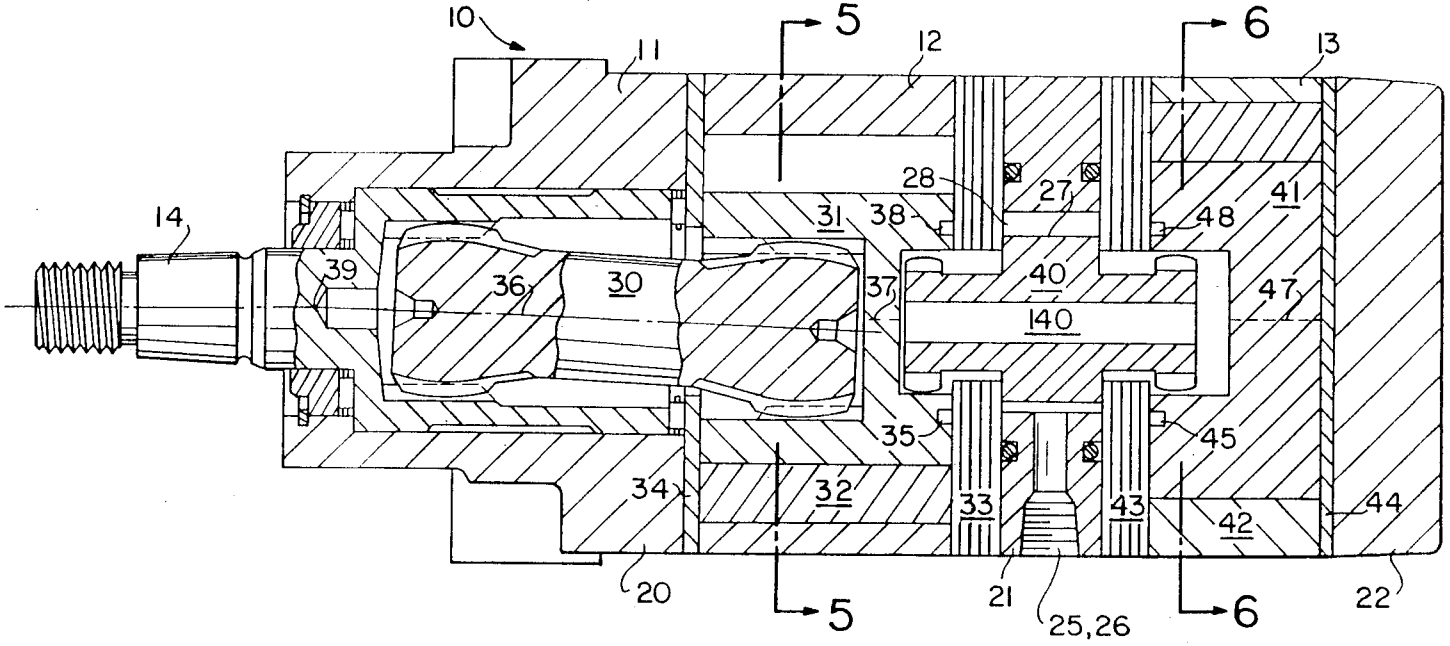
FIG. 4 is a central longitudinal cross-sectional view of a double rotor gerotor motor incorporating the invention of the application.
Figure 6:
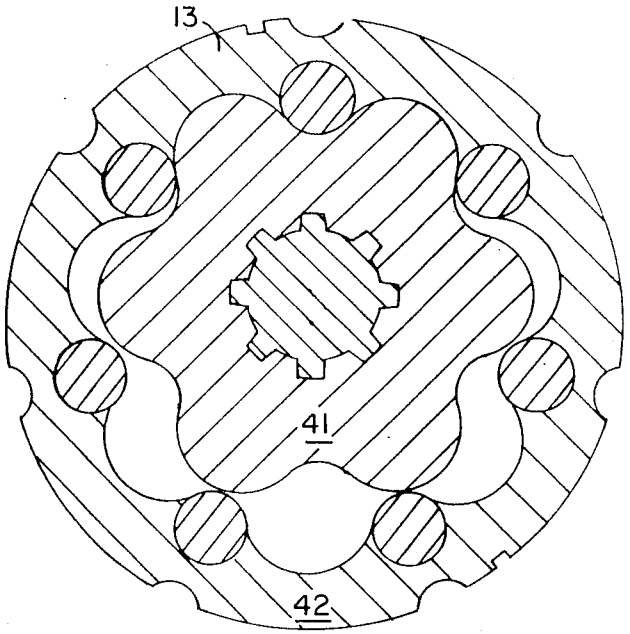
FIG. 6 is a widthwise cross-sectional view of the gerotor motor of FIG. 4 taken generally along lines 6—6 of that FIGURE.
Figure 5:
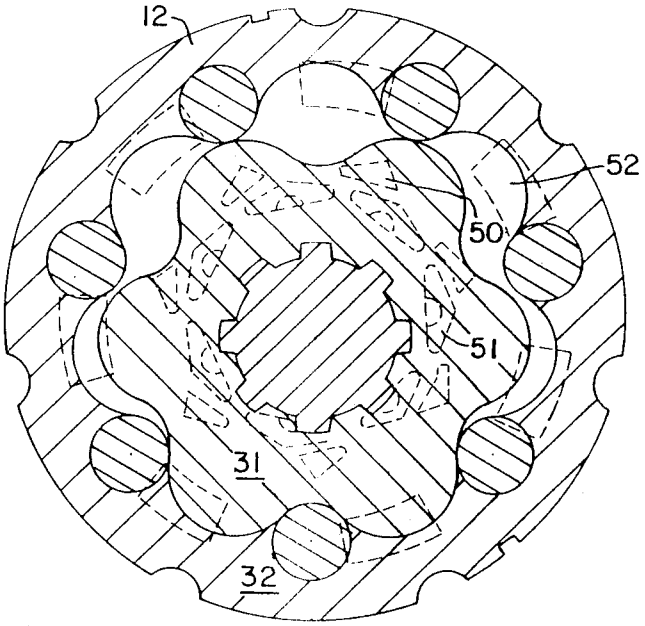
FIG. 5 is a widthwise cross-sectional view of the gerotor motor of FIG. 4 taken generally along lines 5—5 of that FIGURE.

The rotor 31 is the main operational rotary member for the device. The rotor 31 (in combination with the surrounding stator 32) defines a set of expanding and contracting gerotor cells about the rotor's outer circumference. In operation pressurized fluid or other media is selectively fed to/from these cells. To facilitate this operation, it is preferred that the rotor 31 be the main valving member for the device (FIGS. 1 and 4). This commutation and valving is described in Mr. Hollis White's earlier U.S. Pat. No. 4,357,133 issued Nov.2, 1982. In this preferred device the center 36 of the rotor 31 is connected to one port 25 while a surrounding ring 35 is connected to the other port 26 to form the valving openings for the device. In the invention of this present application the outside diameter of at least one of the valving openings is smaller than the outside diameter of the wobblestick drive connection. This can be both openings 36, 35 (as in FIG. 1) or one opening. This reduces the surface area subjected to pressurized fluid while, producing a device with a reduced diameter. For the purposes of this relationship it is preferred that the diameter of the wobblestick drive connection be taken at the root of the splines in the rotor and the diameter of the orbiting valve opening(s) be taken at the outermost extension of such opening. The effective limit for this reduced valve opening diameter is the cross-sectional area necessary to pass fluid to/from the valving connections in the manifold plate 33 during the ongoing operation of the device—i.e. sufficient fluid must pass between the valve openings and the gerotor cells to operate the device (note that the orbit of the rotor 31 must be taken into account in this determination). In the embodiment of FIG. 1 the reduced area also provides an end 39 stop for the wobblestick within the rotor 31. The outside diameters of both openings 35, 36 are also smaller than the inside diameter of the wobblestick drive connection further reducing the size of the device.

Figure 3:
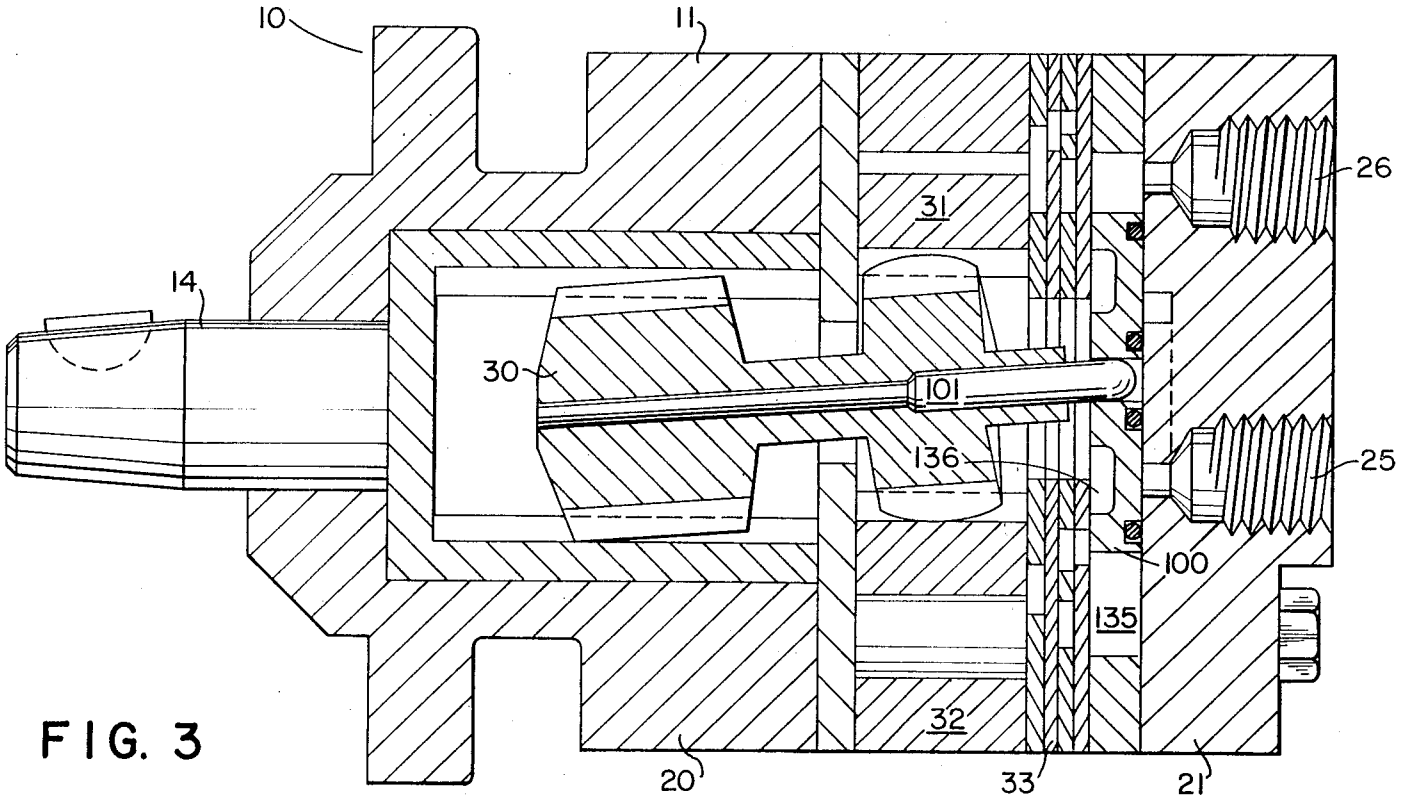
FIG. 3 is a central longitudinal cross-sectional view of an alternate embodiment of the invention.

The reduction of area of the invention means less area to be sealed and less leakage. The reduction of diameter means that the device is smaller and in addition facilitates the balancing of forces within the device. In an isolated valve device (later described—FIG. 3) the reduced diameter also reduces the mass of the orbiting valve. [Since this orbiting valve swings at multiples of rotor speed (for example 3600 times at 600 rpm output), this reduction in mass significantly reduces the vibration of the device]. Other advantages also follow.

The manifold plate 33 is the main commutation/valving fluid connection for the device 10. This manifold plate is built of multi-plate construction. This construction and the operation are described in U.S. Pat. No. 4,474,544 issued Oct. 2, 1984. All openings are rotatively-oriented to match the angular offset of the gerotor structure 12. The manifold plate 33 is designed to match the angular orientation of the rotor-stator 31–32 combination. The rotor 31 single plane commutates and valves its respective gerotor structure 12.

The fluid ports 25, 26 connect the gerotor to external devices. These ports 25, 26 for the manifold plate 33 are located on the porting member 21. One fluid port 25 connects directly to the center 36 of the rotor 31. The other fluid port 26 connects to the valving ring 35 of the rotor 31 through the manifold plate 33.

The balancing plate 34 is designed to balance the high pressure feed of the single sided commutation and valving on the rotor 31. The balancing plate 34 is a thin, flexible steel plate fixedly connected at its outer edges to the housing 11 or its porting 21 end plate. The balancing plate covers a small pocket behind it which pocket is connected to the high pressure feed for the device through the rotor 31. This is accomplished by including a small opening(s) leading to the pocket in the balancing plate in the area swept by the high pressure groove in the rotor. If the device is designed for bi-directional operation, small check valves are utilized to insure appropriate high pressure only connection (rather than alternate high-low pressure connection). The pockets could also be separately directly plumbed to a high pressure feed port 25, 26. The size of the pocket is designed to match the rotor's imbalance for the incoming high pressure The balancing plate is described in detail in the U.S. patent application Ser. No. 798,301 filed Nov. 15, 1985 by Mr. White, now U.S. Pat. No. 4,717,320.

The invention has been described in its preferred form with a certain degree of particularity. It is to be understood that numerous changes in the described embodiment may be had without deviating from the invention as claimed. For example the invention has been described in an integral rotor valve embodiment. Other embodiments are also possible. These include isolated valve devices (FIG. 3) and multiple rotor devices (FIG. 4).

An isolated valve device (FIG. 3) separates the valve 100 from the rotor 31. A small pin 101 connects the valve 100 to the wobblestick 30 for orbiting therewith. A description of the operation of a isolated valve device can be found in Mr. White's application Ser. No. 080,606 filed Aug. 3, 1988. In the particular embodiment shown in this present application the outside diameter of the center opening 136 of the valve 100 is smaller than the outside diameter of the wobblestick drive connection to the rotor 31. [To have the outside diameters of both openings 136 and 135 smaller one could modify opening 135 into a groove in the valve 100 (instead of the area about the circumference of the valve 100 as shown) and reduce the dimensions of the value 100 and manifold plate 33 so as to provide the intended dimensions]. The manifold plate 33 is similar to the manifold of FIG. 1, differing duly in respect to the orientation of the valving openings in the manifold (i.e. reversed in recognition of the fact that the orbiting valve is on the opposite side of the rotor instead of incorporated therein) and in sizing (i.e. the orbiting valve being spaced from the rotor has a slightly larger orbit).

A multiple rotor device (FIG. 4) has multiple rotors. In the device shown a secondary gerotor structure 13 has been included with a secondary wobblestick 40 the associate drive connection between the rotors 31–41 (The numbers of the gerotor structure 13 track the numbers of the gerotor structure 12 plus ten—i.e. beginning with 40 instead of 30). The secondary wobblestick 40 is located axially in line with the axial centers 37, 47 of both rotors 31, 41. The wobblestick 40 is located in its operating position by an external flange 27 extending off of its center portion into a corresponding groove 28 in the porting member 21 In the operation of the device the axial centers 37, 47 and the axis of the secondary wobblestick 40 all together a phantom cylinder about the central axis of the device (an extension of the longitudinal axis of the drive shaft 14 in line with the axial centers of the stators 32, 42 of the gerotor structures 12, 13). The wobblestick 40 is therefor short and tightly fitted into the rotors 31, 41 and sized to transfer the torque of but the single rotor 41. Note that in other embodiments of the invention rotors could trace differing sized circles with or without rotational congruence to meet the actual or desired requirements of the particular application, in which case the wobblestick 40 may have to provide an angular compensation between rotors 31, 41.

The rotors 31, 41 are differentially sized and angularly oriented in respect to their stators to optimize their operation. Each pair of rotor-stator 31–32, 41–42 are also differentially angularly offset from the other to smooth the linearity of the output torque of the device and otherwise reduce stalling. The key is to eliminate or minimize any points of minimum displacement in the cells in both gerotor structures at all times. This can be produced by altering the angular orientation of the rotors (as in FIG. 4), varying the number of lobes on the rotors (i.e. 6 lobes on rotor 31 and 11 lobes on rotor 41), or otherwise. This is preferred from the alternative of using one rotor to valve both gerotor structures (as could occur by connecting the gerotor cell openings of one manifold plate 33, 43 to the appropriate gerotor cells of both gerotor structures 12, 13 and eliminating the other manifold plate 33, 43). Alternately, if independent gerotor structure operation is desired, each gerotor structure 12, 13 could have its own independent ports. This could be accomplished for example by switching the manifold plate 33 with the balancing plate 34 for the structure 12 and providing the additional ports in the housing 11 for the manifold plate 33.

In the multiple rotor device again the outside diameter of the valving opening 35 is smaller than the outside diameter of the wobblestick drive connection to the rotor 31 (45 is also).

Other changes are also possible.

What is claimed is:

1. In a gerotor device having a rotor with a wobblestick drive connection having a diameter, gerotor cells surrounding the rotor, an orbiting valve having radially inner and outer valving openings, one such valving opening having an outside diameter and a housing having bi-directional passages in the housing leading from the valving openings to the gerotor cells, the improvement of the diameter of the wobblestick drive connection being larger than the outside diameter of one such valving opening of the orbiting valve.

2. The improved gerotor device of claim 1 characterized in that the diameter of the wobblestick drive connection is the inside diameter of such connection.

3. The improved gerotor device of claim 1 characterized in that the diameter of the wobblestick drive connection is the outside diameter of such connection.

4. The improved gerotor device of claim 1 characterized in that the orbiting valve is integral with the rotor.

5. The improved gerotor device of claim 1 characterized in that the orbiting valve is separate from the rotor.

6. The improved gerotor device of claim 1 wherein the inner and outer valving opening each have an outside diameter, and characterized in that the diameter of the wobblestick drive connection is larger than the outside diameters of both of the inner and outer valving openings of the orbiting valve.

7. The improved gerotor device of claim 6 characterized in that the diameter of the wobblestick drive connection is the inside diameter of such connection.

8. The improved gerotor device of claim 6 characterized in that the diameter of the wobblestick drive connection is the outside diameter of such connection.

9. In a gerotor device having an orbiting rotor with a wobblestick drive connection having an outside diameter, gerotor cells surrounding the rotor, an orbiting valve having integral radially inner and outer valving openings, one integral valving opening having an outside diameter, and a housing having bi-directional passages in the housing leading from the valving openings to the gerotor cells, the improvement of the outside diameter of the wobblestick drive connection being larger than the outside diameter of the integral valving opening.

10. The improved gerotor device of claim 9 wherein the rotor has two flat axial end surfaces and characterized in that the wobblestick drive connection is on one surface of the rotor and the inner and outer valving openings are on the other surface of the rotor.

11. The improved gerotor device of claim 9 wherein there is fluid commutation to the valving openings and characterized in that the fluid commutation to the valving openings is on the same surface of the rotor as the valving openings.

12. In a gerotor device having an orbiting rotor with a wobblestick drive connection having an outside diameter, gerotor cells surrounding the rotor, an orbiting valve having radially inner and outer valving openings, one such valving opening with an outside diameter, and a housing having bi-directional passages in the housing leading from the valving openings to the gerotor cells, the orbiting valve orbited by an extension off of the wobblestick, the improvement of the outside diameter of the wobblestick drive connection being larger than the outside diameter of the one such valving opening.

13. The improved gerotor device of claim 12 characterized in that a manifold plate is located between the rotor and the orbiting valve.

14. The improved gerotor device of claim 12 wherein there is a porting plate connecting the device to fluid and characterized in that the porting plate is located on the opposite side of the orbiting valve from the rotor.

15. In a gerotor device having an orbiting rotor with a wobblestick drive connection having an outside diameter, gerotor cells surrounding the rotor, an orbiting valve having radially inner and outer valving openings, the orbiting valve being driven by an extension off of the wobblestick, the radially inner valving opening in such orbiting valve having an outer diameter, and a housing having bi-directional passages in the housing leading from the valving openings to the expanding and contracting gerotor cells, the improvement of the outside diameter of the wobblestick drive connection to the rotor being larger than the outside diameter of the radially inner valving opening in the orbiting valve.

16. The improved gerotor device of claim 14 characterized in that the bi-directional passages in the housing leading from the valving openings to the gerotor cells are in a manifold plate.

17. The improved gerotor device of claim 15 wherein there is a porting plate connecting the gerotor device to fluid and characterized in that the porting plate is on the opposite side of the orbiting valve from the rotor.

18. In a gerotor device having an orbiting rotor with a wobblestick drive connection having an outside diameter, gerotor cells surrounding the rotor, a housing, an orbiting valve having the radially inner and outer valving openings, the valving openings cooperating with bi-directional passages in the housing leading from the valving openings to gerotor cells to valve the device, the radially inner valving opening having an outside diameter, the orbiting valve orbited by an extension off of the wobblestick, the improvement of the outside diameter of the wobblestick drive connection being larger than the outside diameter of the radially inward valving opening in the orbiting valve.

* * * * *